US005491870A

United States Patent [19]

Holmes

[11] Patent Number: 5,491,870

[45] Date of Patent: Feb. 20, 1996

[54] PORTABLE WORKSTATION DUST COLLECTION ATTACHMENT

[76] Inventor: Grover C. Holmes, 1540 Robin Hood, Lafayette, Colo. 80026

[21] Appl. No.: 192,353

[22] Filed: Feb. 7, 1994

[51] Int. Cl.[6] ..... A47L 5/38

[52] U.S. Cl. ..... 15/301; 15/310

[58] Field of Search ..... 15/300.1, 301, 15/310, 311, 339, 415.1, 418, 422

[56] References Cited

U.S. PATENT DOCUMENTS

| | | | |
|---|---|---|---|
| 1,371,468 | 3/1921 | Burges | 15/300.1 |
| 1,908,560 | 5/1933 | Ruemelin | 15/301 |
| 1,942,453 | 1/1934 | Ruemelin | 15/301 |
| 2,121,753 | 6/1938 | Cornell | 15/300.1 |
| 3,060,483 | 10/1962 | Black | 15/339 |
| 4,596,060 | 6/1986 | Schmidt | 15/301 |
| 4,607,413 | 8/1986 | Schmidt | 15/301 |
| 5,295,771 | 3/1994 | Wehrmann | 15/300.1 |
| 5,311,637 | 5/1994 | Broussard | 15/301 |

FOREIGN PATENT DOCUMENTS

| | | | |
|---|---|---|---|
| 1286525 | 1/1962 | France | 15/415.1 |
| 806279 | 3/1951 | Germany | 15/300.1 |

*Primary Examiner*—Stephen F. Gerrity
*Assistant Examiner*—Terrence R. Till

[57] ABSTRACT

Described is a new portable workstation dust collection attachment for collecting and removing, in combination with a suctioning filter apparatus such as a vacuum cleaner, dust and other airborne particulate matter produced during processing of a workpiece. The portable workstation dust collection attachment comprises a funnel-shaped dust intake structure having an upwardly opening rectangular suctioning aperture defined by the large end of the funnel and a pressure port defined by the small end of the funnel. Also included is an upwardly projecting protective plate whereby the dust is guided into the suctioning aperture. A supporting stand is further included.

6 Claims, 4 Drawing Sheets

FIG 3
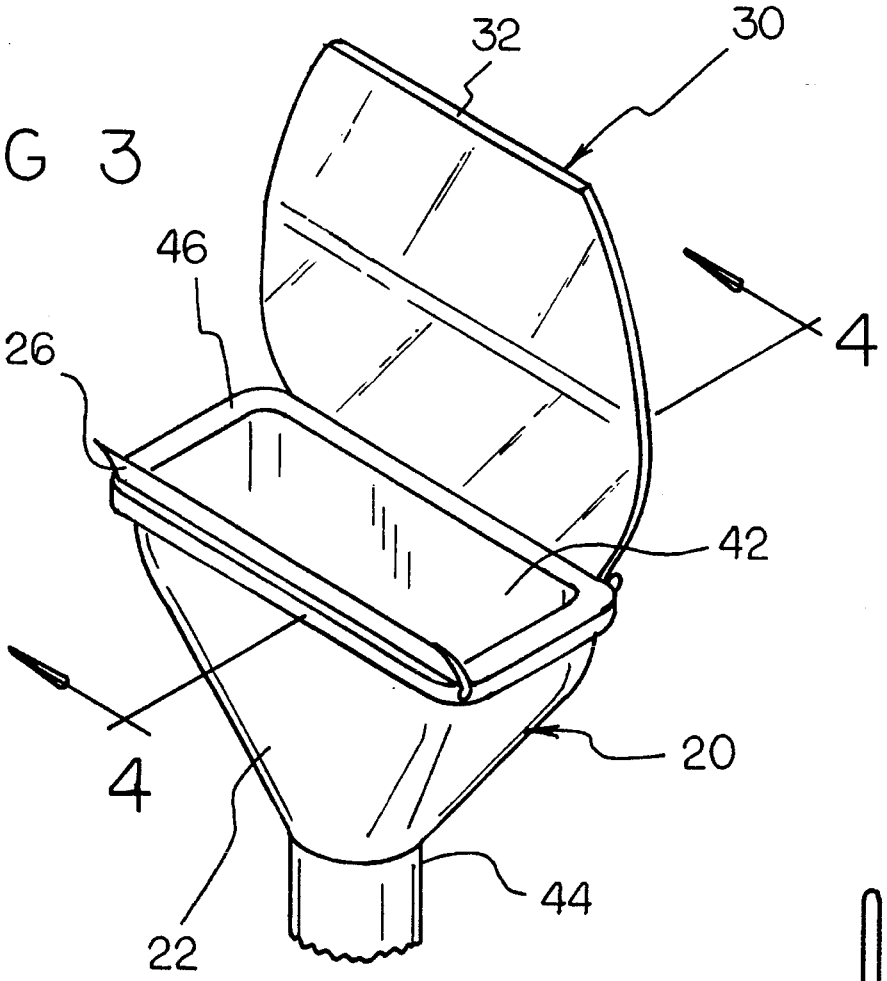
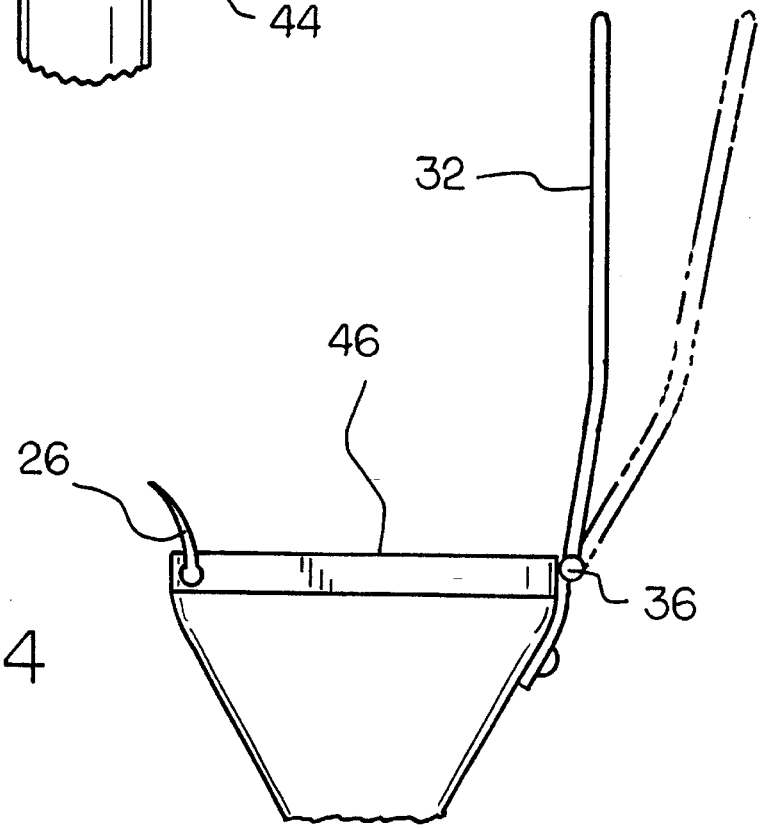
FIG 4

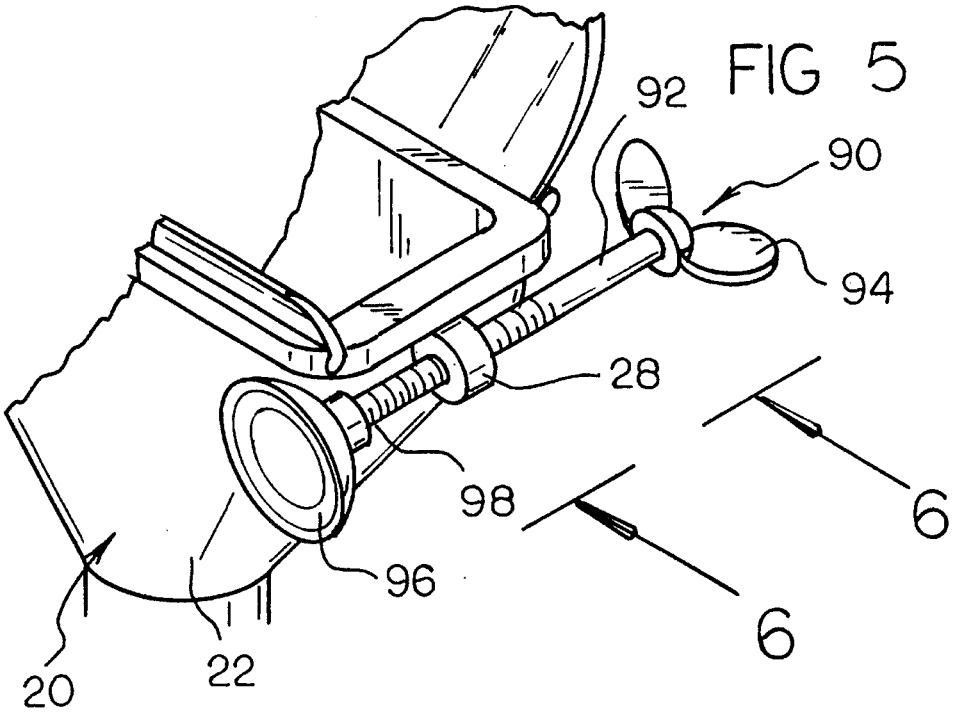
FIG 5
FIG 6
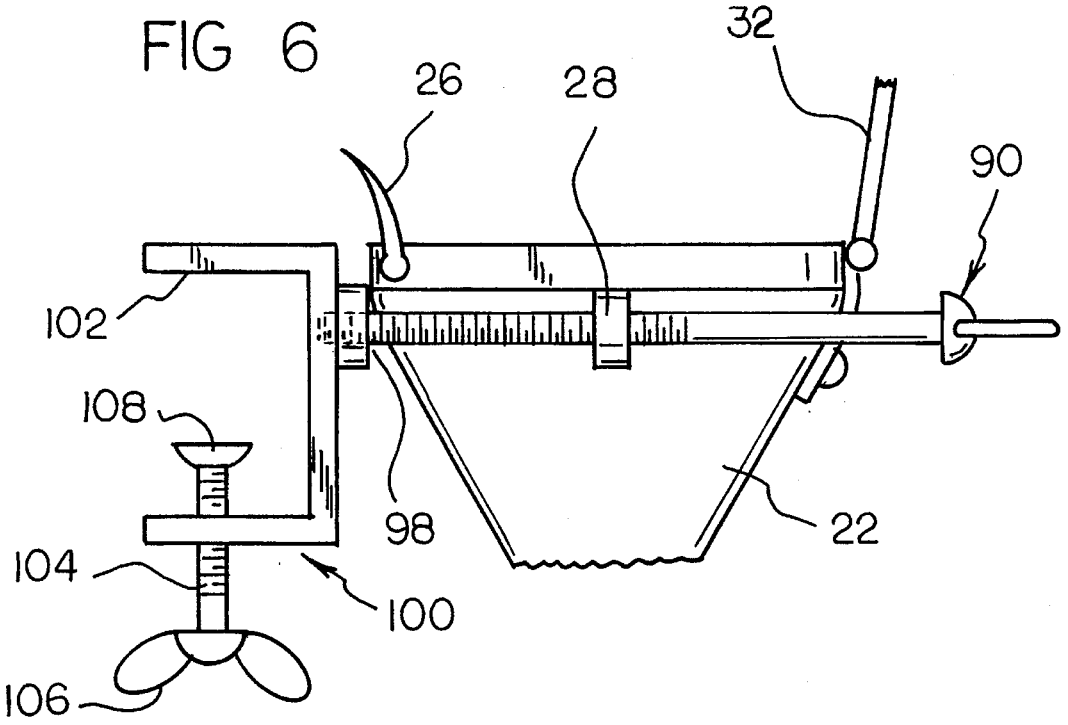

PORTABLE WORKSTATION DUST COLLECTION ATTACHMENT

BACKGROUND OF THE INVENTION

1. Field of the Invention

The present invention relates to dust removal devices and more particularly pertains to portable workstation dust collection attachments which may be adapted for collecting and removing, in combination with a suctioning filter apparatus such as a vacuum cleaner, dust and other airborne particulate matter produced during processing of a workpiece.

2. Description of the Prior Art

The use of dust removal devices is known in the prior art. More specifically, dust removal devices heretofore devised and utilized for the purpose of removing dust from a work area are known to consist basically of familiar, expected and obvious structural configurations, notwithstanding the myriad of designs encompassed by the crowded prior art which have been developed for the fulfillment of countless objectives and requirements.

The present invention is directed to improving devices for collecting and removing dust and other airborne particulate matter produced during processing of a workpiece in a manner which is safe, secure, economical and aesthetically pleasing.

For example, U.S. Pat. No. 4,490,881 to Schmidt discloses a dust exhauster for a precision mechanics work table which can be fitted as a ready connect unit beneath the work top of a conventional work table. For this purpose, the housing is L-shaped, the suction opening being in the front end of the substantially horizontal leg of the housing and the large surface outlet(s) being in the vertical leg of the housing. The housing bounds, in its installed position, the foot knee region for the user of the work area.

U.S. Pat. No. 4,607,413 to Schmidt et al. describes a work station with suctioning device for the aspiration of suctionable material which is produced during the processing of workpieces, and a protective plate which guides the suctionable material into the suctioning opening. The protective plate concurrently screens the working personnel carrying out the processing, in particular the head of the person, against the incident suctionable material. The protective plate which is carried by a special mounting support can be moved upwardly prior to the implementing of work without the formation of suctionable material, upwardly away from the suctioning opening in a simple manner into a non-hindering inoperative position.

The prior art also discloses a dust collection apparatus as shown in U.S. Pat. No. 4,977,638 to Best which consists of apparatus for a home workshop to collect wood dust from a plurality of work stations and deposit the dust in a container. There are suction hoses, one to each work station. At their outlet ends, the hoses are connected to a single control means operable to selectively connect one hose at a time to the container.

Other patents of interest are U.S. Pat. No. 3,930,630 to Wulff which describes a vacuum cleaner support apparatus and U.S. Pat. No. 4,597,551 to Ciechanowski et al. which discloses a vacuum wand holder.

While these devices fulfill their respective, particular objectives and requirements, the aforementioned patents do not disclose a portable workstation dust collection attachment for collecting and removing, in combination with a suctioning filter apparatus such as a vacuum cleaner, dust and other airborne particulate matter produced during processing of a workpiece.

In this respect, the portable workstation dust collection attachment according to the present invention substantially departs from the conventional concepts and designs of the prior art, and in so doing provides an apparatus primarily developed for the purpose of collecting and removing, in combination with a suctioning filter apparatus such as a vacuum cleaner, dust and other airborne particulate matter produced during processing of a workpiece.

Therefore, it can be appreciated that there exists a continuing need for new and improved portable workstation dust collection attachments which can be used for collecting and removing dust and other airborne particulate matter produced during processing of a workpiece. In this regard, the present invention substantially fulfills this need.

As illustrated by the background art, efforts are continuously being made in an attempt to develop devices for removing dust from a work area. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of dust removal devices now present in the prior art, the present invention provides an improved dust removal devices construction wherein the same can be utilized for collecting and removing, in combination with a suctioning filter apparatus such as a vacuum cleaner, dust and other airborne particulate matter produced during processing of a workpiece. As such, the general purpose of the present invention, which will be described subsequently in greater detail, is to provide a new and improved portable workstation dust collection attachment apparatus and method which has all the advantages of the prior art dust removal devices and none of the disadvantages.

The invention is defined by the appended claims with the specific embodiment shown in the attached drawings. For the purpose of summarizing the invention, the invention may be incorporated into a new and improved portable workstation dust collection attachment for collecting and removing, in combination with a suctioning filter apparatus, dust and other airborne particulate matter produced during processing of a workpiece. The portable workstation dust collection attachment comprises a funnel-shaped dust intake structure having an upwardly opening rectangular suctioning aperture defined by the large end of the funnel. Also included is a protective plate. The portable workstation dust collection attachment further has a suction duct pivotally connected at it's proximal end to the tubular connector whereby the suction duct is in communicating relationship with the pressure port of the intake structure. A supporting stand, whereby the intake structure is adjustably held in position on a work surface for convenient use, is additionally included.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an portable workstation dust collection attachment for collecting and removing, in combination with a suctioning filter apparatus such as a vacuum cleaner, dust and other airborne particulate matter produced during processing of a workpiece.

It is therefore an additional object of the present invention to provide a new and improved portable workstation dust collection attachment which has all the advantages of the prior art dust removal devices and none of the disadvantages.

It is another object of the present invention to provide a new and improved portable workstation dust collection attachment which may be easily and efficiently manufactured and marketed.

It is a further object of the present invention to provide a new and improved portable workstation dust collection attachment which is of a durable and reliable construction.

An even further object of the present invention is to provide a new and improved portable workstation dust collection attachment which is susceptible of a low cost of manufacture with regard to both materials and labor, and which accordingly is then susceptible of low prices of sale to the consuming public, thereby making such portable workstation dust collection attachments economically available to the buying public.

Still yet another object of the present invention is to provide a new and improved portable workstation dust collection attachment which provides in the apparatuses and methods of the prior art some of the advantages thereof, while simultaneously overcoming some of the disadvantages normally associated therewith.

Still yet another object of the present invention is to provide a new and improved portable workstation dust collection attachment that can be used with a variety of different workstations while being easily adjustable to a position convenient for all users.

Yet another object of the present invention is to provide a new and improved portable workstation dust collection attachment that is adapted for use with any conventional vacuum cleaner or other suctioning filter apparatus commonly available.

Even still another object of the present invention is to provide a new and improved portable workstation dust collection attachment that additionally provides a protective shield to safeguard the user's face and upper body from dust and projected fragments produced during processing of a workpiece.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective detail view of the intake structure, edge gasket, and hinged protective plate of the present invention.

FIG. 4 is a partial sectional view of the invention of FIG. 3 taken along the line 4—4 and illustrating pivotal movement of the protective plate relative to the intake structure.

FIG. 5 is a partial perspective view of the present invention showing a suction cup assembly attachment method.

FIG. 6 is a partial side elevational view of the present invention showing a C-clamp assembly attachment method.

DESCRIPTION OF THE PREFERRED EMBODIMENT

Figure 1:
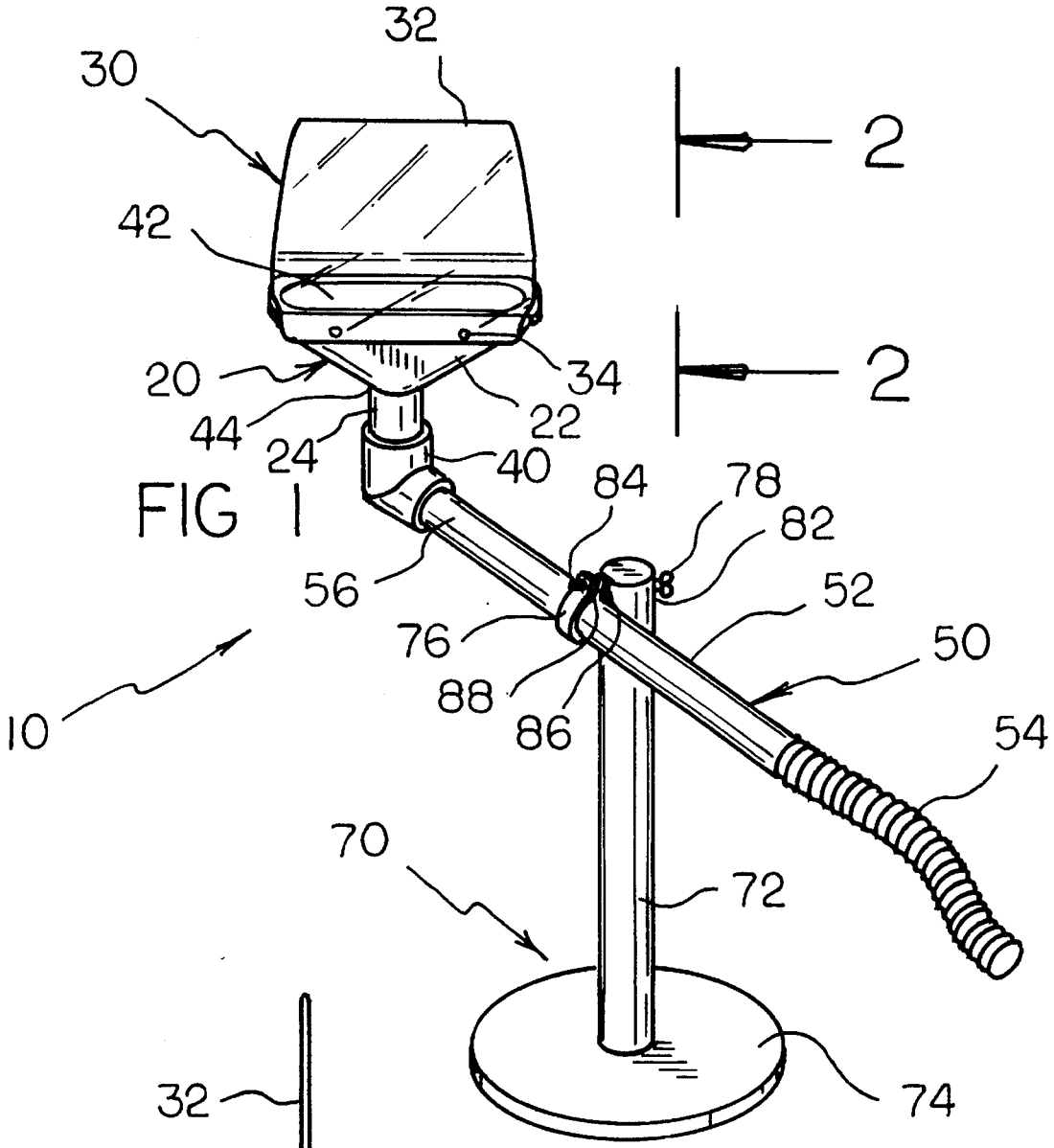
FIG. 1 is a perspective view of the new and improved portable workstation dust collection attachment.
Figure 2:
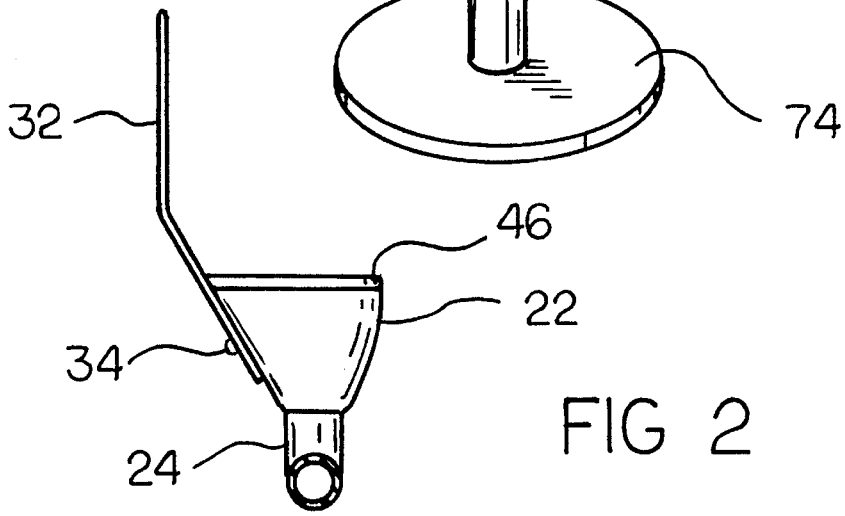
FIG. 2 is a side elevational detail view of the intake structure and protective plate of the invention of FIG. 1.

With reference now to the drawings, and in particular to FIG. 1 thereof, a new and improved portable workstation dust collection attachment embodying the principles and concepts of the present invention and generally designated by the reference numeral will be described.

From an overview standpoint, the portable workstation dust collection attachment is adapted for use with an external suctioning filter apparatus such as a vacuum cleaner for collecting and removing dust and other airborne particulate matter produced during processing of a workpiece. See FIG. 1.

With reference now to FIGS. 1–4 and more specifically, it will be noted that a new and improved portable workstation dust collection attachment 10 for collecting and removing, in combination with an external suctioning filter apparatus (not shown), dust and other airborne particulate matter produced during processing of a workpiece, is shown.

The portable workstation dust collection attachment 10 comprises a funnel-shaped dust intake structure 20 having an upwardly opening rectangular suctioning aperture 42 defined by the large end of the funnel 22. The intake structure 20 also has a raised lip 46 surrounding the suctioning aperture 42. The intake structure 20 additionally has a downwardly opening pressure port 44 defined by the small end of the funnel 22.

The pressure port 44 has a tubular connector 24 extending therefrom whereto a suction source may be attached. The suctioning aperture 42 has a region of low air pressure proximal thereto when the pressure port 44 is connected to the suction source whereby dust produced during processing of the workpiece within the low pressure region is drawn into the intake structure 20. The intake structure may additionally include a resilient edge gasket member 26, shown in FIG. 3, extending along a portion of the lip 46.

The gasket member 26 projects upwardly from the lip 46 whereagainst the workpiece may be pressed during processing to guide the dust into the suction aperture 42. Also included is a protective plate 30 projecting upwardly from the raised lip 46 whereby the dust is guided into the suctioning aperture 42. The protective plate 30 is transparent wherethrough a user may view the workpiece while simultaneously being shielded from contact with the dust produced by workpiece processing.

Figure 7:
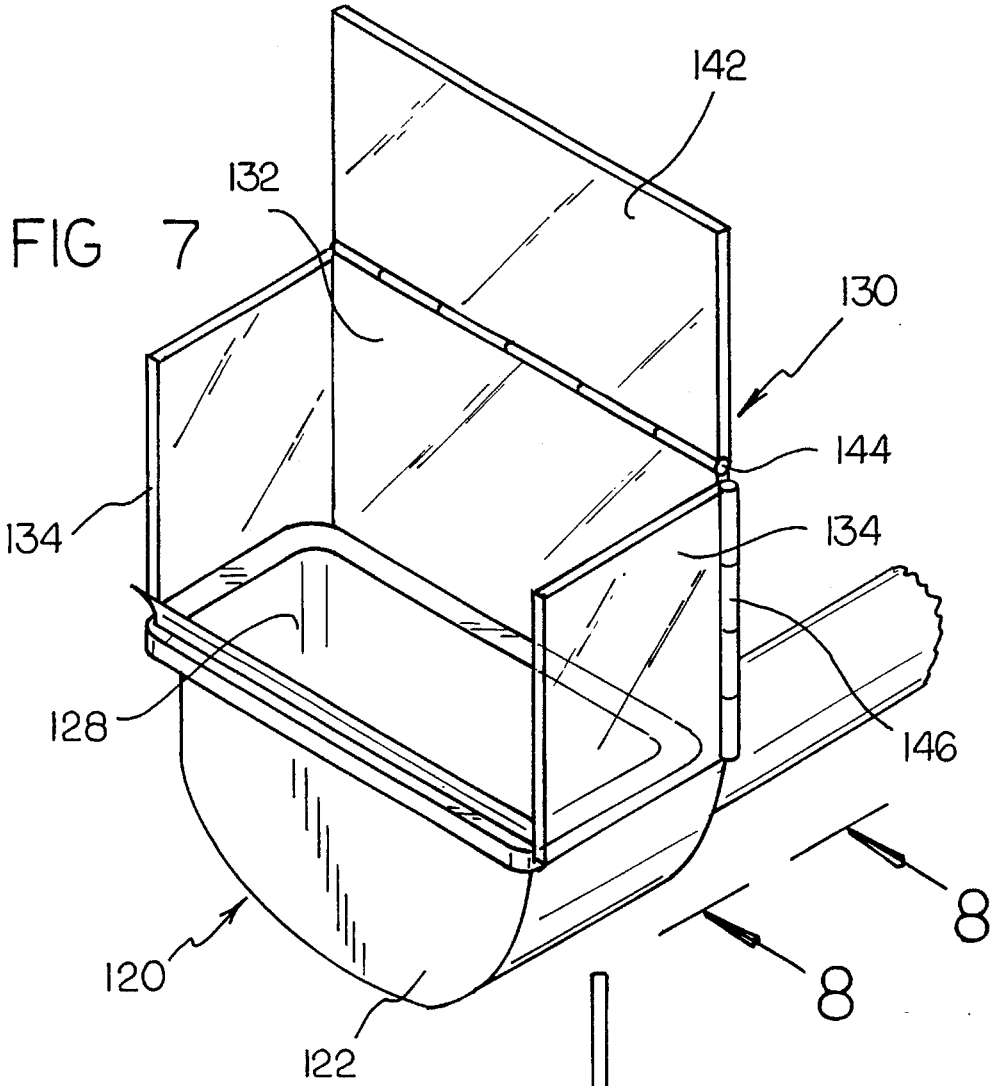
FIG. 7 is a partial perspective view of an alternate embodiment of the present invention wherein the pressure port is located on the side of the intake structure. Also shown is a modified protective plate which includes additional hinged side and top plates.
Figure 8:
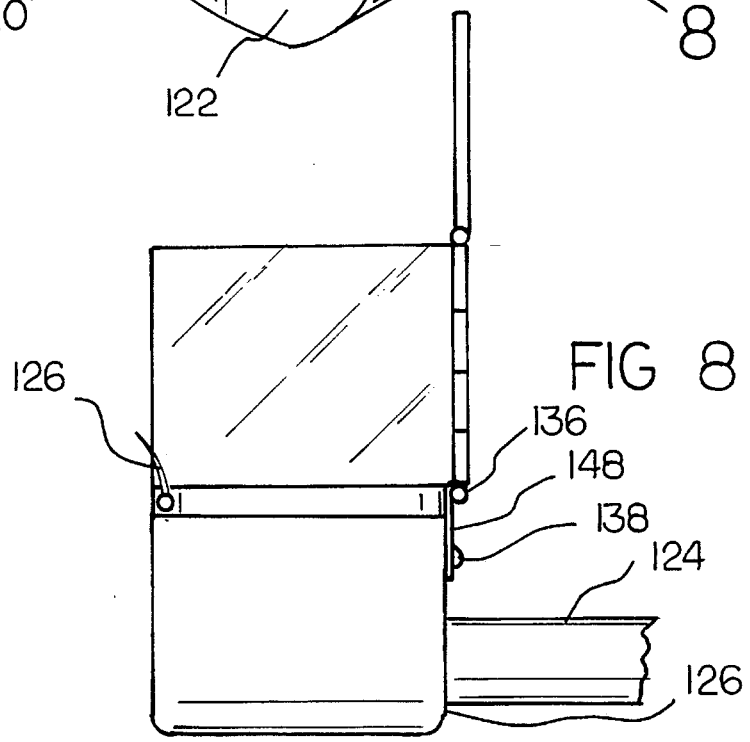
FIG. 8 is a side elevational view of the invention of FIG. 7.

The protective plate 30 may also be hinged, best shown in FIG. 4, whereby the protective plate may be pivoted on the hinge 36 relative to the plane of the suction aperture 42. FIGS. 7 and 8 illustrate an alternate embodiment of the protective plate, designated by the reference numeral 130, which additionally includes side 134 and top 142 extension plates hingedly connected thereto whereby the dust is more efficiently directed into the suction aperture.

Referring again to FIG. 1, the portable workstation dust collection attachment 10 further has a suction duct 50 pivotally connected at it's proximal end 56 to the tubular connector 24 by means of a tubular elbow connector 40 whereby the suction duct 50 is in communicating relationship with the pressure port 44 of the intake structure 20.

The suction duct 50 also communicates at it's distal end 58 with the external suctioning filter apparatus (not shown) whereby a suction source is provided at the pressure port 44. The suction duct 50 additionally carries the dust drawn into the intake structure 20 to the suctioning filter apparatus for collection therein. The suction duct 50 has a rigid proximal portion whereby an intake structure support member 52 is formed, the suction duct 50 also has a flexible distal portion 54 whereby the external suctioning filter apparatus may be located at any convenient nearby position without regard for duct routing.

A supporting stand 70, whereby the intake structure 20 is adjustably held in position on a work surface for convenient use, is additionally included. See FIG. 1. The supporting stand 70 comprises a weighted base member 74 heavy enough and large enough to support the intake structure 20 with the attached suction duct 50. A support column 72, projecting vertically upwardly from the base member 74, is included.

The support column 72 additionally has a lateral hole 82 therethrough near it's upper end. Further included in the supporting stand is a band clamp 76 slipedly encircling the rigid portion 52 of the suction duct. The band clamp 76 has a transverse split 86 therethrough whereby spaced facing ends are defined, the facing ends each having a projecting flange 88 thereon. The flanges 88 each having a hole therethrough.

A bolt 78 extends through the lateral hole 82 in the support column. The bolt 78 also extends through the holes in the band clamp 76 and is threadedly engaged with a nut 84 whereby pivotally attaching band clamp 76 to the support column 72. Tightening the nut 84 prevents longitudinal movement of the suction duct 50 relative to the band clamp 76 and additionally prevents rotational movement of the clamp 76 and suction duct 50 relative to the support column 72.

In a first modification of the preferred embodiment of the portable workstation dust collection attachment 10, shown in FIG. 6, the support means is an attachment clamp whereby the intake structure 20 may be removedly mounted to the edge of the work surface. The attachment clamp comprises a pair of threaded mounting ears 28 projecting laterally from opposing sides of the intake structure 20.

A bolt 90 is threadedly engaged with each of the mounting ears 28, the bolts 90 being identical to each other. The bolts 90 also have thumb wing extensions 94 on the head ends thereof to facilitate hand rotation of the bolts 90. A pair of C-clamp assemblies 100 is clampedly attached to the edge of the work surface (not shown). The C-clamp assemblies 100 are rotationally connected to the free ends of each of the bolts 98 whereby rotation of the bolts 90 moves the intake structure 20 toward and away from the edge of the work surface on a plane parallel to the work surface.

FIG. 5 illustrates a first modification to the second embodiment in which the C-clamp assemblies 100 are replaced with suction cup assemblies 96 whereby the intake structure 20 may be suctionally mounted to a flat surface (not shown).

A third embodiment of the portable workstation dust collection attachment, designated by the reference numeral 120, wherein the pressure port 126 opens laterally from the intake structure 122, is shown in FIGS. 7 and 8. The pressure port 126 has a tubular connector 124 extending therefrom whereto a suction source may be attached. The suctioning aperture 128 has a region of low air pressure proximal thereto when the pressure port 126 is connected to the suction source whereby dust produced during processing of the workpiece within the low pressure region is drawn into the intake structure 122 and subsequently carried away to the external suctioning filter apparatus (not shown).

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new and improved portable workstation dust collection attachment for cooperable use with a work surface for collecting and removing dust and other airborne particulate matter produced during processing of a workpiece, the portable workstation dust collection attachment comprising:

a funnel-shaped dust intake structure having an upwardly opening rectangular suctioning aperture defined by a large end thereof, the intake structure also having a raised lip surrounding the suctioning aperture, the intake structure additionally having a pressure port defined by a small end thereof, the pressure port having a tubular connector extending therefrom whereto a suction source is attached, the suctioning aperture having a region of low air pressure proximal thereto when the pressure port is connected to the suction source whereby dust produced during processing of the workpiece within the low pressure region is drawn into the intake structure;

a protective plate projecting upwardly from a portion of the raised lip whereby the dust is guided into the suctioning aperture, the protective plate is transparent wherethrough a user views the workpiece while simultaneously being shielded from contact with the dust produced by workpiece processing;

a suction duct pivotally connected at a proximal end thereof to the tubular connector whereby the suction duct is in communicating relationship with the pressure port of the intake structure, the suction duct having a rigid proximal portion forming an intake structure support member, the suction duct has a flexible distal portion;

a supporting stand whereby the intake structure is adjustably held in position on a work surface for convenient use, the supporting stand comprising:

a base member to support the intake structure with the suction duct;

a support column projecting vertically upwardly from the base member, the support column having a lateral hole therethrough near the upper end thereof;

a band clamp encircling the rigid portion of the suction duct, the band clamp having a transverse split therethrough whereby spaced facing ends are defined, the facing ends each having a projecting flange thereon, the flanges each having a hole therethrough;

a nut; and a bolt extending through the lateral hole in the support column, the bolt also extending through the holes in the band clamp whereby pivotally attaching band clamp to the support column, the bolt further threadedly engaged with the nut whereby tightening the nut prevents longitudinal movement of the suction duct relative to the band clamp.

2. A new and improved portable workstation dust collection attachment for cooperable use with a work surface for collecting and removing dust and other airborne particulate matter produced during processing of a workpiece, the portable workstation dust collection attachment comprising:

dust intake means having a suctioning aperture, the intake means also having a pressure port whereto a suction source is attached, the suctioning aperture having a region of low air pressure proximal thereto when the pressure port is connected to the suction source whereby dust produced during processing of the workpiece within the low pressure region is drawn into the intake means;

duct means communicating at a proximal end thereof with the pressure port of the intake structure;

support means whereby the intake structure is adjustably held in position on a work surface for convenient use;

wherein the dust intake means comprising a funnel-shaped intake structure, a large end of the structure is the suctioning aperture, a small end of the structure is the pressure port;

wherein the suctioning aperture additionally includes a surrounding raised lip;

a protective plate projecting upwardly from the raised lip whereby the dust is guided into the suctioning aperture, the protective plate is transparent wherethrough a user views the workpiece while simultaneously being shielded from contact with the dust produced by workpiece processing;

wherein the protective plate is hinged whereby the protective plate is pivoted relative to the suction aperture; an wherein the protective plate additionally includes side and top extension plates hingedly connected thereto whereby the dust is more efficiently directed into the suction aperture.

3. The portable workstation dust collection attachment of claim 2 wherein the intake structure additionally includes a resilient edge gasket member extending along a portion of the lip, the gasket member also projecting upwardly from the lip whereagainst the workpiece may be pressed during processing to guide the dust into the suction aperture.

4. The portable workstation dust collection attachment of claim 3 wherein the support means is a support stand, the support stand comprising: a base member having weight and dimensions to support the intake structure with attached suction duct; a support column projecting vertically upwardly from the base member, the support column having a lateral hole therethrough near the upper end thereof; a band clamp encircling the rigid portion of the suction duct, the band clamp having a transverse split therethrough whereby spaced facing ends are defined, the facing ends each having a projecting flange thereon, the flanges each having a hole therethrough; a nut; and a bolt extending through the lateral hole in the support column, the bolt also extending through the holes in the band clamp whereby pivotally attaching band clamp to the support column, the bolt is further threadedly engaged with the nut whereby tightening the nut prevents longitudinal movement of the suction duct relative to the band clamp.

5. The portable workstation dust collection attachment of claim 4 wherein the support means is an attachment clamp whereby the intake structure is removedly mounted to the edge of the work surface, the attachment clamp comprising: at least one threaded mounting ear projecting laterally from at least one opposing side of the intake structure; a least one bolt threadedly engaged with the mounting ear, the bolt having thumb wing extensions on a head end thereof to facilitate hand rotation of the bolt; at least one C-clamp assembly clampedly attached to the edge of the work surface, the C-clamp assembly is rotationally connected to the free end of the bolt whereby rotation of the bolt moves the intake structure toward and away from the edge of the work surface parallel to the work surface.

6. The portable workstation dust collection attachment of claim 4 wherein the support means is a suction cup assembly whereby the intake structure is removedly mounted to the work surface, the suction cup assembly comprising: at least one threaded mounting ear projecting laterally from at least one opposing side of the intake structure; at least one bolt threadedly engaged with the mounting ear, the bolt having thumb wing extensions on a head end thereof to facilitate hand rotation of the bolt; at least one suction cup attached to the free end of the bolt.

* * * * *